US006665988B2

(12) United States Patent
Toivola et al.

(10) Patent No.: US 6,665,988 B2
(45) Date of Patent: Dec. 23, 2003

(54) ELEVATOR LANDING DOOR STRUCTURE

(75) Inventors: Juha Toivola, Hyvinkää(FI); Helge Korhonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/852,802

(22) Filed: May 11, 2001

(65) Prior Publication Data

US 2002/0046907 A1 Apr. 25, 2002

Related U.S. Application Data

(63) Continuation of application No. PCT/FI99/00933, filed on Nov. 9, 1999.

(51) Int. Cl.[7] ..... E06B 1/04
(52) U.S. Cl. ..... 52/204.1; 52/30; 52/236.3
(58) Field of Search ..... 52/204.1, 211, 52/30, 236.3; 187/313

(56) References Cited

U.S. PATENT DOCUMENTS 3,382,631 A * 5/1968 Halpern ..... 52/211
3,601,938 A * 8/1971 Loomis ..... 187/408
3,686,808 A * 8/1972 Loomis ..... 52/211
3,984,952 A * 10/1976 Loomis ..... 33/194
5,096,020 A * 3/1992 Korhonen ..... 187/359
5,794,746 A * 8/1998 Ketonen et al. ..... 187/333
6,145,630 A * 11/2000 Friedman et al. ..... 187/313

FOREIGN PATENT DOCUMENTS

| | | | |
|---|---|---|---|
| EP | 0-475-074 A1 * | 8/1991 | ..... B66B/13/30 |
| EP | A475074 | 3/1992 | |
| JP | A2310287 | 12/1990 | |
| JP | A8333965 | 12/1996 | |
| JP | A11011841 | 1/1999 | |

* cited by examiner

*Primary Examiner*—Carl D. Friedman
*Assistant Examiner*—Basil Katcheves
(74) *Attorney, Agent, or Firm*—Birch, Stewart, Kolasch & Birch, LLP

(57) ABSTRACT

Elevator landing door structure, comprising a door sill (1, 5) fixed to the lower edge of a landing door opening, an overhead supporter (2, 9) and at least one door panel (3) movably mounted on the overhead supporter. Furthermore, the door structure comprises vertical frames (4, 6) fixed to the door sill (1, 5) on either side of the door opening, the overhead supporter being attached to said vertical frames. The vertical frames (4, 6) are fastened by their upper parts via junctures that are rigid in the horizontal plane but capable of yielding in the vertical direction.

13 Claims, 2 Drawing Sheets

ELEVATOR LANDING DOOR STRUCTURE

This application is a Continuation of PCT International Application No. PCT/FI99/00933 filed on Nov. 9, 1999, which was published in English and which designated the United States and on which priority is claimed under 35 U.S.C. §120, the entire contents of which are hereby incorporated by reference.

FIELD OF THE INVENTION

The present invention relates to an elevator landing door structure.

BACKGROUND OF THE INVENTION

Traditionally, the landing doors of an elevator are mounted by attaching both the upper and lower ends of the door frame directly to the building. In other words, the door sill is fixed to the lower edge of the door opening while the overhead supporter is fixed separately to the upper edge of the door opening. A drawback with such a structure is above all the difficulty of installation and structural complexity. Both the door sill and the overhead supporter must be installed separately according to accurate measurements.

Previously known are also solutions in which the landing door is fixed to a secondary structure attached to the building. For instance, in elevator shafts of steel construction, landing doors have been mounted using an H-shaped steel frame generally attached by its lower end to the floor slab and by its upper end to the slab supporting the floor above. Such a frame requires a great deal of design work and is expensive to manufacture and difficult to install.

In general, mounting the landing door is a problematic and difficult task because it is difficult to find suitable attachment points for both the door sill and the overhead supporter and because the shaft dimensions may vary considerably from floor to floor. Nevertheless, the door openings must be precisely aligned along the same straight line. Moreover, the landing door structures cannot be rigidly connected to each other between different floors because the elevator shaft undergoes longitudinal motion to which the elevator structures must adapt themselves.

BRIEF SUMMARY OF THE INVENTION

The object of the invention is to eliminate the drawbacks referred to above. A specific object of the invention is to disclose a new type of elevator landing door structure that is as simple as possible as well as cheap to manufacture and install.

The landing door structure of the invention comprises a door sill attached to the lower edge of the landing door opening, an overhead supporter and at least one door panel movable along and supported by the overhead supporter. According to the invention, vertical frames are fixed to the door sill after it has been mounted in place on the floor, on either side of the door opening, and the overhead supporter is mounted on the vertical frames. In other words, the vertical frames are rigidly mounted and supported by the door sill. Moreover, the vertical frames are fixed by their upper parts via junctures that are rigid in a horizontal plane but at the same time flexible or yielding in the vertical direction so that the effects of possible vertical movements of the shaft structure are freely transmitted via the junctures holding the upper part of the vertical frames.

The vertical frame is preferably attached by its upper part to another corresponding vertical frame which is mounted at the edge of the door opening on the next floor above and fixed to the door sill on that floor. This fixture is so implemented that the vertical frames, disposed substantially one above the other as vertical extensions of each other, are rigidly connected to each other in the horizontal plane but the juncture between them permits sliding or yielding in the longitudinal direction of the vertical frames as necessary due to thermal expansion and other movements occurring in the structures of the elevator shaft.

The length of the vertical frame is preferably so designed that it comprises an upper extension extending above the point of attachment of the overhead supporter, the vertical frame being fixed by said extension via a juncture rigid in the horizontal plane. Similarly, the vertical frame preferably extends below the point of attachment of the door sill so that the part of the vertical frame below the door sill forms a lower extension to which the upper end of the vertical frame at the edge of the door opening on the floor below can be attached.

The vertical frames vertically aligned with each other on different floors and forming extensions of each other can be connected to each other in a variety of ways. The essential point is only that the junctures ensure that the vertical frames are held rigidly in position in a horizontal plane while allowing vertical movements of the vertical frames in relation to each other. Thus, the juncture may consist of a suitable sleeve surrounding the vertical frames or a suitable clamp connection in which the vertical frames are locked between two elements pressed towards each other. Another essential point is that the vertical frames are not directly butted on each other; instead, a suitable gap is left between the vertical frames at the juncture. The vertical frame may be made of various types of rigid profile steel, such as U channel section, H section, T section or round or cornered tubular profile steel.

It is also possible within the scope of the inventive idea to fasten the vertical frame by its upper part directly to the door sill fixed to the lower edge of the door opening on the floor above. In this case, too, the juncture is implemented as a structure that is rigid in the horizontal plane but capable of yielding appropriately in the vertical direction.

Especially in the case of an elevator door structure for the topmost floor and also in applications where the floor-to-floor distances are particularly large, the upper part of the vertical frame can be fastened directly to the shaft wall. In this embodiment, too, the juncture is so implemented that it is rigid in the horizontal plane but capable of yielding appropriately in the vertical direction.

The vertical frame is preferably attached to the end of the door sill. Likewise, the overhead supporter is preferably attached by its ends between the two vertical frames, although, depending on the installation space and the profile of the vertical frame used, other ways of implementing the attachment are possible.

DETAILED DESCRIPTION OF THE INVENTION

The elevator landing door structure of the invention provides significant advantages as compared with prior art. The door structure is very simple and easy to erect. After the door sills have been fitted in the landing door openings of the elevator shaft and fixed in place, no further accurate measurements are needed. The vertical frames are provided with precise attachment points, e.g. perforations, both for the door sill and the overhead supporter. Thus, the vertical frames are fixed to the ends of the door sill and the overhead supporter is fixed to the upper ends of the vertical frames. At the same time, the upper ends of the vertical frames are connected to a corresponding vertical frame fixed to the door sill on the floor above.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, which are given by way of illustration only, and thus are not limitative of the present invention, and which present diagrams of different embodiments of the elevator landing door structure of the invention.

The drawings present embodiments of the invention in a diagrammatic form comprising two floors. To give a clearer illustration of the actual inventive structure, shaft structures such as door openings and landings are not shown in the figure.

Figure 1:
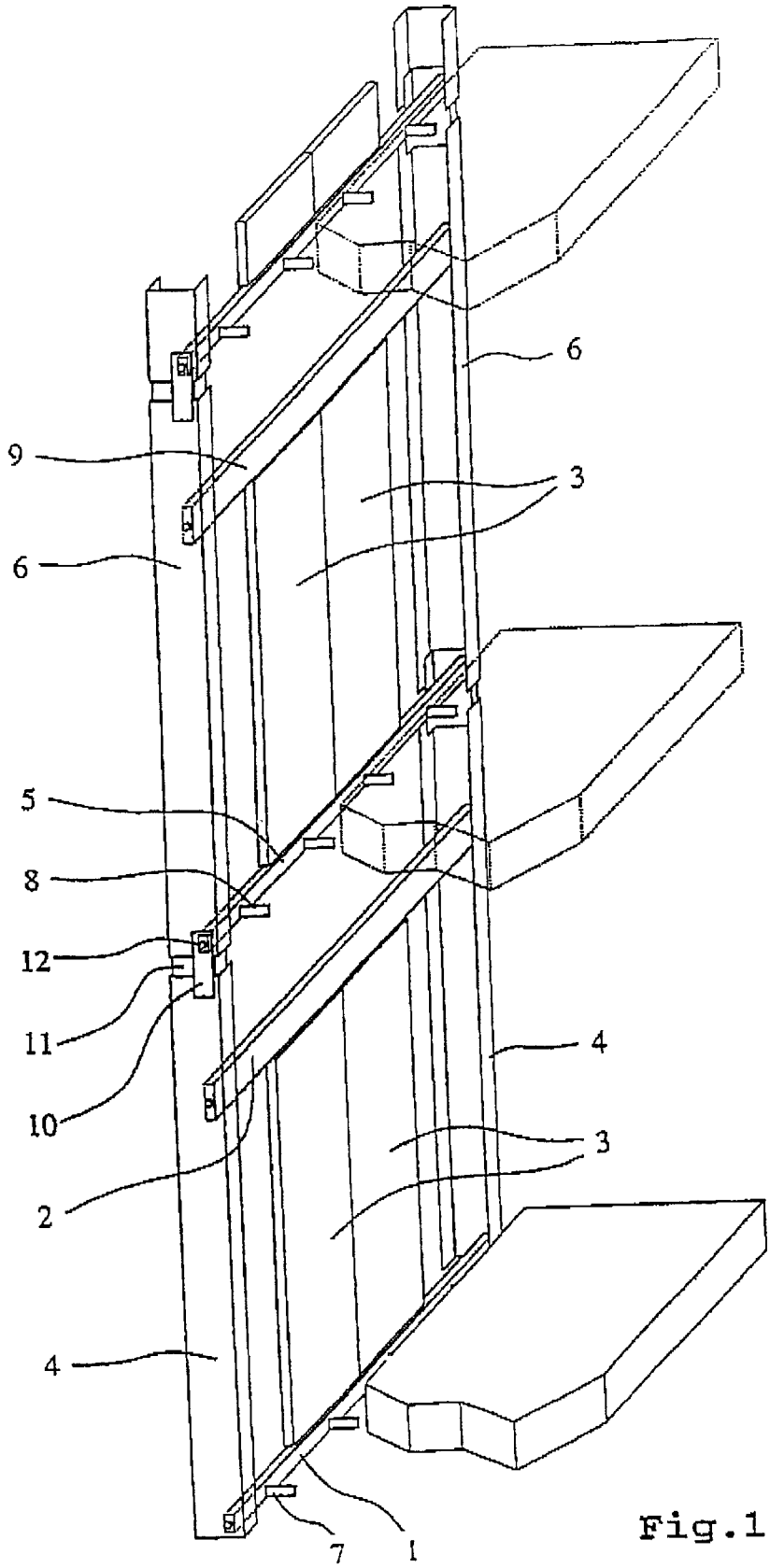
FIG. 1 is a diagram representing an embodiment of the invention, showing a partial view comprising two floors.

In the door structure in FIG. 1, a door sill 1 is fixedly attached to the lower edge of the door opening on the lower floor by means of fastening elements 7. A corresponding door sill 5 is fixed to the lower edge of the door opening on the upper floor by means of fastening elements 8. After this, a rigid vertical frame 4 is fixed to one end of the door sill 1 and an identical vertical frame is also fixed to the other end of the door sill 1. Thus, the door sill 1 remains between the vertical frames 4. In the same way, an overhead supporter 2 is mounted between the vertical frames 4 at the upper edge of the door opening. The vertical frames 4 are provided with predesigned mounting holes or equivalent attachment points for both the door sill 1 and the overhead supporter, so when these are to be installed, no measurements need to be carried out.

On the upper floor, in a corresponding manner, vertical frames 6 are fixed to either end of the door sill 5 and an overhead supporter 9 is fixed between the upper parts of these vertical frames. The door panels 3 can then be suspended on the overhead supporters 2 and 9 in the normal manner.

The vertical frames 4 or the overhead supporter 2 are not fixed directly to the shaft structures at any point. Instead, the vertical frames 4 are attached by their upper ends to the lower ends of the vertical frames 6 mounted on the floor above, using clamps fitted to the profile shapes of the vertical frames 4 and 6, said clamps consisting of a clamping block 10 partially surrounding the U channel on its outer side and a counter block 11 fitted to the inner side of the U channels 4 and 6. These components are squeezed against each other by means of a bolt 12 so that the upper end of vertical frame 4 and the lower end of vertical frame 6 are clamped between them. In this way, a juncture is formed between the vertical frames 4 and 6 that is rigid in the horizontal plane but still capable of yielding in the longitudinal direction of the vertical frames as necessary.

Thus, the entire weight of the door structure of the invention is transmitted via the door sill to the floor while the upper part of the door structure is only horizontally rigidly connected to the shaft structures via the door sill of the door structure above it.

Figure 2:
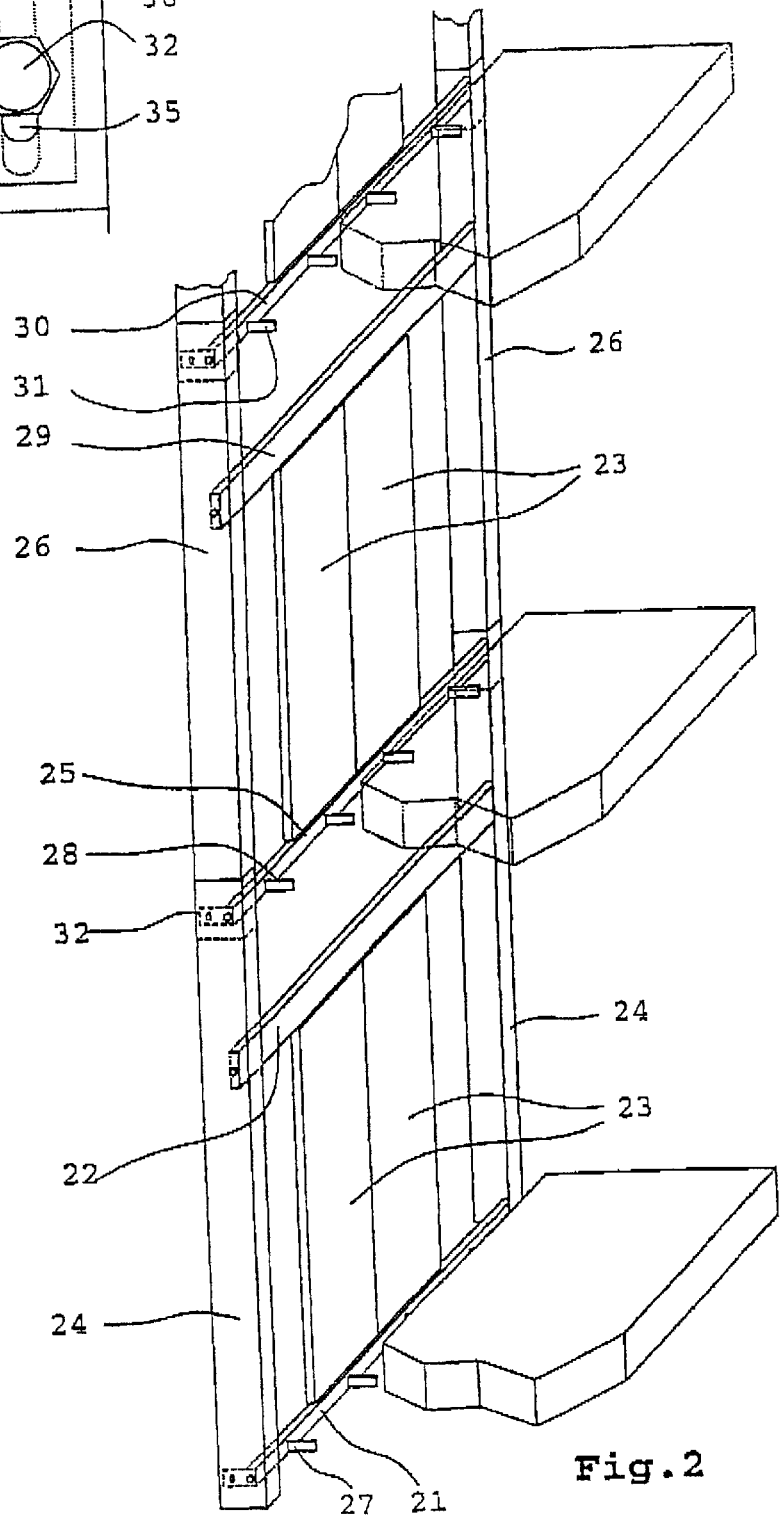
FIG. 2 is a diagram representing another embodiment of the invention, showing a partial view comprising two floors.

In FIG. 2, shaft structures such as door openings and landings have been omitted to give a clearer illustration of the actual inventive structure. In the door structure, a door sill 30 is fixedly attached to the lower edge of the upper floor door opening by means of fastening elements 31. After this, a rigid vertical frame 26 is fixed to one end of the door sill 30 and a similar vertical frame is also fixed to the other end of the door sill 30, leaving the vertical frames hanging. The door sill 30 thus remains between the vertical frames 26. The vertical frames 26 are provided with predesigned mounting holes for both the door sill 30, the intermediate door sill 25 and the overhead supporter 29, so when these are to be installed, no measurements need to be carried out.

In a corresponding manner, a door sill 25 is attached to the lower edge of the middle floor door opening by means of fastening elements 28. After this, a rigid first vertical frame 24 is fixed to one end of the door sill 25 and a similar vertical frame to the other end of the door sill 25, using fixing screws 32 which in the second vertical frame 26 go through a hole 36 and in the first vertical frame 24 through a hole 35 and the door sill 25, the vertical frames being left hanging. The second vertical frame 26 remains between the first vertical frame 24 and the door sill 25. The first vertical frame 24 hangs supported by the fixing screw 32 used as fastening element, and the clearance in the elongated hole 35 is below the screw 32. Thus, the vertical frames 24 and 26 are connected together by a screw joint which is rigid in the horizontal plane but is still capable of yielding in the longitudinal direction of the vertical frames as necessary when subjected to great forces. In a corresponding manner, the door sill 21 for the lower floor is fixed to the lower edge of the door opening by means of fastening elements 27.

Figure 3:
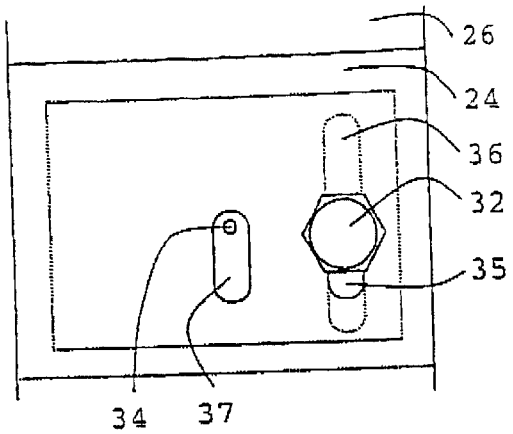
FIG. 3 presents a magnified illustration of the solution of the invention.

The elongated hole 36 shown in FIG. 3 is designed to allow for the manufacturing tolerance of the floor-to-floor distance in the building, ensuring that the pre-fabricated vertical frame will fit in place. Next, a hole is drilled through an initial hole in the door sill 25 and through the vertical frame 26, and a lock pin 34 serving as a fastening element is mounted to prevent movement of the door sill 25 and the second vertical frame 26 relative to each other. The first vertical frame 24 is provided with an elongated hole 37 in the region around the lock pin 34 so that the lock pin 34 does not touch the first vertical frame 24 and a significant portion of the clearance remains below the lock pin 34. The screw 32 and lock pin 34 used as fastening elements lock the first vertical frame 24 and the second vertical frame 26, which are provided with elongated holes 35 and 37, and the door sill 25 together and the lock pin 34 can move downward in the elongated hole 37.

Next, the overhead supporter 29 of the landing doors is mounted on the vertical frames 26. The door panels 23 can then be suspended on the overhead supporter 29 in the usual manner. The vertical frames 26 and the overhead supporter 29 are not fixed directly to the shaft structures at any point. Contraction of the building generates a large vertical force which will overcome the frictional force produced by the screw 32 used as fastening element, causing the door sill 25 attached to the landing floor to move downward. The second vertical frame 26, being connected to the door sill 25 with a lock pin 34, will follow the door sill, and the overhead supporter 29, being attached to the second vertical frame 26, will also follow the door sill 25. The lock pin 34 can move freely downward in the elongated hole 37 in the first vertical frame 24.

The above description presents one arrangement designed to ensure that the sliding will occur between the lower vertical frame 24 on the one hand and the upper vertical frame 26 and the door sill 25 tied together on the other hand, thus maintaining the distance between the door sill 25 and the overhead supporter 29 unchanged.

The entire weight of the door structure of the invention is transmitted via the door sill to the floor while the upper part of the door structure is only horizontally rigidly connected to the shaft structures via the door sill of the door structure above it.

In the foregoing, the invention has been described by way of example with reference to the attached drawing while different embodiments of the invention are possible within the scope of the inventive idea defined in the claims.

What is claimed is:

1. An elevator landing door structure comprising:

an upper door structure and a lower door structure, each including:

a door sill fixed to a lower edge of a landing door opening;

an overhead supporter;

at least on door panel movably mounted on the overhead supporter;

vertical frames fixed to the door sill on either side of the door opening, the overhead supporter being attached to the vertical frames, the vertical frames being fastened by their upper parts via junctures that are rigid in a horizontal plane but being yieldable in a vertical direction, the vertical frames having elongated holes at upper ends thereof, the upper ends of the vertical frames of the lower door structure overlapping lower ends of the vertical frames of the upper door structure; and at least the lower door structure including a fastening element to fix together the overlapping ends of the vertical frames of the upper and the lower door structures and the door sill of the upper door structure, the fastening element including a lock pin being downwardly movable in the elongated hole of at least one of the vertical frames of the lower door structure.

2. The door structure as defined in claim 1, wherein the vertical frames of the lower door structure extend from the door sill of the lower door structure to the upper door sill of the upper door structure and are fixed to both of the door sills.

3. The door structure as defined in claim 1, wherein the vertical frames of the lower door structure are attached by their upper ends to the door sill of the upper door structure via junctures yieldable in the vertical direction.

4. The door structure as defined in claim 1, wherein the vertical frames of the lower door structure are fixed to the door sill of the lower door structure in a manner permitting no movement relative to the door sill of the lower door structure.

5. The door structure as defined in claim 1, wherein the vertical frames of the lower door structure are attached by their upper ends both to the door sill of the lower upper structure and to the vertical frames of the upper door structure with the fastening element.

6. The door structure as defined in claim 1, wherein the elongated holes in the upper ends of the vertical frames of the lower upper structure are in a region around the lock pin.

7. The door structure as defined in claim 1, wherein at least one of the vertical frames of the lower door structure comprises an upper extension extending above a point of attachment of the overhead supporter thereof, the vertical frames of the lower door structure being fastened by the extension.

8. The door structure as defined in claim 1, wherein at least one of the vertical frames of the upper door structure fixed to the door sill of the upper door structure comprises a lower extension extending below a point of attachment of the door sill of the lower upper structure, the vertical frames of the lower door structure being fastened to the extension.

9. The door structure as defined in claim 1, wherein the vertical frames of the lower door structure are fastened by the upper ends thereof to the door sill mounted on a lower edge of the door of the upper door structure.

10. The door structure as defined in claim 1, wherein the vertical frames of the lower door structure are fixed to ends of the door sill of the lower door structure.

11. The door structure as defined in claim 1, wherein the overhead supporter of the lower door structure is fixed by its end between two of the vertical frames of the lower door structure.

12. The door structure as defined in claim 1, wherein the upper ends of the vertical frames of the lower door structure are higher than the lower ends of the vertical frames of the upper door structure.

13. The door structure as defined in claim 1, further comprising a fixing screw of the fastening element extending through second elongated holes formed the upper ends of the vertical frames of the lower door structure which overlap with third elongated holes formed in lower ends of the vertical frames of the upper door structure, the fixing screw penetrating the door sill of the upper door structure.

* * * * *

UNITED STATES PATENT AND TRADEMARK OFFICE

CERTIFICATE OF CORRECTION

PATENT NO. : 6,665,988 B2
DATED : December 23, 2003
INVENTOR(S) : Toivola et al.

It is certified that error appears in the above-identified patent and that said Letters Patent is hereby corrected as shown below:

Title page,
Item [30], Foreign Application Priority Data, please insert the following:

-- Foreign Application Priority Data

| | | | |
|---|---|---|---|
| Nov. 13, 1998 | [FI] | Finland | 982462 |
| Oct. 28, 1999 | [FI] | Finland | 992317 -- |

Signed and Sealed this

First Day of June, 2004

JON W. DUDAS
*Acting Director of the United States Patent and Trademark Office*